US007204261B1

(12) United States Patent
Wu

(10) Patent No.: US 7,204,261 B1
(45) Date of Patent: Apr. 17, 2007

(54) LOWER NEST STRUCTURE OF COLLAPSIBLE UMBRELLA

(76) Inventor: Tsun-Zong Wu, 8F., No. 76, Lane 103, Sec. 2, Neihu Rd., Taipei (TW)

( * ) Notice: Subject to any disclaimer, the term of this patent is extended or adjusted under 35 U.S.C. 154(b) by 20 days.

(21) Appl. No.: 11/233,100

(22) Filed: Sep. 23, 2005

(51) Int. Cl.
*A45B 25/08* (2006.01)

(52) U.S. Cl. ..... 135/28; 135/38; 135/25.1

(58) Field of Classification Search ..... 135/28, 135/25.1, 15.1, 25.4, 37, 38, 393, 40; *A45B 25/08*
See application file for complete search history.

(56) References Cited

U.S. PATENT DOCUMENTS

| | | | | |
|---|---|---|---|---|
| 508,189 | A * | 11/1893 | Swan | 135/39 |
| 5,494,064 | A * | 2/1996 | Chuang Lee | 135/28 |
| 6,070,602 | A * | 6/2000 | Ling Kuo | 135/25.4 |
| 6,431,191 | B1 * | 8/2002 | Wang | 135/40 |
| 6,758,229 | B2 * | 7/2004 | Wang | 135/41 |
| 7,089,950 | B2 * | 8/2006 | Lin et al. | 135/38 |
| 2005/0241687 | A1 * | 11/2005 | Ko | 135/39 |

* cited by examiner

*Primary Examiner*—Peter M. Cuomo
*Assistant Examiner*—Noah Chandler Hawk
(74) *Attorney, Agent, or Firm*—Leong C. Lei

(57) ABSTRACT

A lower nest structure for a collapsible umbrella is provided, which contains a tubular member and a body member. The tubular member is sleeved over the central shaft and contains a tubular section and an operation knob. A pair of guiding holes and a pair of wedges located below the guiding holes are interleaved around the tubular section. The body member has a ring section to sleeve over the tubular section of the tubular member. The ring section is confined by the bottom surfaces of the wedges and the operation knob. A pair of opposing hook elements is configured on top of the ring section which could be flexibly expanded outward, causing a force to clasp inward. On the top ends of the hook elements, reversed hooks are configured to penetrate through the guiding holes of the tubular member and into the positioning holes of the central shaft for fixedly positioning the lower nest. When the tubular member is pulled downward, the reversed hooks would be relieved from the positioning holes so that the lower nest could slide downward to close the umbrella.

3 Claims, 5 Drawing Sheets

LOWER NEST STRUCTURE OF COLLAPSIBLE UMBRELLA

BACKGROUND OF THE INVENTION (a) Technical Field of the Invention

The present invention generally relates to collapsible umbrellas and, more particularly, to the lower nest structure of collapsible umbrellas for opening and closing collapsible umbrellas.

(b) Description of the Prior Art

Conventionally, a collapsible umbrella contains a central shaft, an upper nest fixedly attached to a top end of the central shaft, a lower nest sliding along the central shaft, and a rib structure whose ribs are connected to both the upper and lower nests. As such, pushing or pulling the lower nest up or down would force the ribs of the rib structure to expand or retract and the collapsible umbrella is thereby opened or closed.

To maintain the umbrella in an open configuration, a positioning mechanism must be supplied to prevent the lower nest from sliding downward.

A conventional positioning mechanism is a resilient stopper extended from the inside of the central shaft. When the umbrella is open, the stopper is beneath the lower rest to prevent it from moving downward. To close the umbrella, the stopper is pressed into the central shaft so that the lower nest could pass the stopper and slide downward.

Using the resilient stopper as a positioning mechanism for the lower nest has a number of disadvantages. First, the resilient stopper is configured inside and extends out of the central shaft. The installation of the resilient stopper is not quite convenient. Secondly, the resilient stopper is usually configured as a blade. It is quite uncomfortable for a user to operate the resilient stopper to close the umbrella. Thirdly and most importantly, when the resilient stopper is pressed to make way for the lower nest, the lower nest would drop very quickly due to the retraction force of the rib structure, a user could easily get hurt if his or her finger is trapped between the resilient stopper and the lower nest.

SUMMARY OF THE INVENTION

The primary purpose of the present invention is to provide a collapsible umbrella, which allows the user to operate the lower nest easily and quickly. When the lower nest is pushed upward to an appropriate position, the umbrella is locked in an open configuration. In addition, when the lower nest is pulled downward, the locking is relieved and the umbrella is closed simultaneously.

The lower nest structure of the present invention contains a tubular member and a body member. The tubular member is sleeved over the central shaft of an umbrella and is able to move up and down along the central shaft. The tubular member contains a tubular section and an operation knob attached to the bottom of the tubular section. A pair of guiding holes and a pair of wedges located below the guiding holes are interleaved around the tubular section to that the two pairs are orthogonal to each other. The guiding holes have a sloped upper edge slanting downward towards the central shaft. The wedges have a protruding bottom surface. The operation knob has a larger diameter and forms a flange. The body member has a ring section to sleeve over the tubular section of the tubular member. The ring section is confined by the bottom surfaces of the wedges and the flange of the operation knob. The height or thickness of the ring section is substantially smaller than the distance between the bottom surfaces of the wedges and the flange of the operation knob, leaving a gap therebetween. A pair of opposing hook elements is configured on top of the ring section which could be flexibly expanded outward, causing a force to clasp inward. On the top ends of the hook elements, reversed hooks are configured to penetrate through the guiding holes of the tubular member and into the positioning holes of the central shaft. The reversed hooks have a sloped surface slanting downward towards the central shaft. When the tubular member along with the body member is pushed upward to an appropriate position, the reversed hooks would penetrate through the guiding holes and into the positioning holes of central shaft and, thereby, the lower nest is fixedly locked to the position. When the tubular member is pulled downward, the sloped upper edges of the guiding holes would lift the reversed hooks out of the positioning holes so that the lower nest could slide downward to close the umbrella. As such, during the umbrella opening and closing operations, a user wouldn't get hurt as the user's fingers never touch the locking mechanism provided by the present invention.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As illustrated in FIGS. 1 to 5, the present invention is applicable to a conventionally structured umbrella, which contains a central shaft 1, an upper nest 2 fixedly configured at a top end of the central shaft 1, and a rib structure 3 whose ribs are connected to both the upper nest 2 and a body member 5 of the lower nest A.

Figure 1:
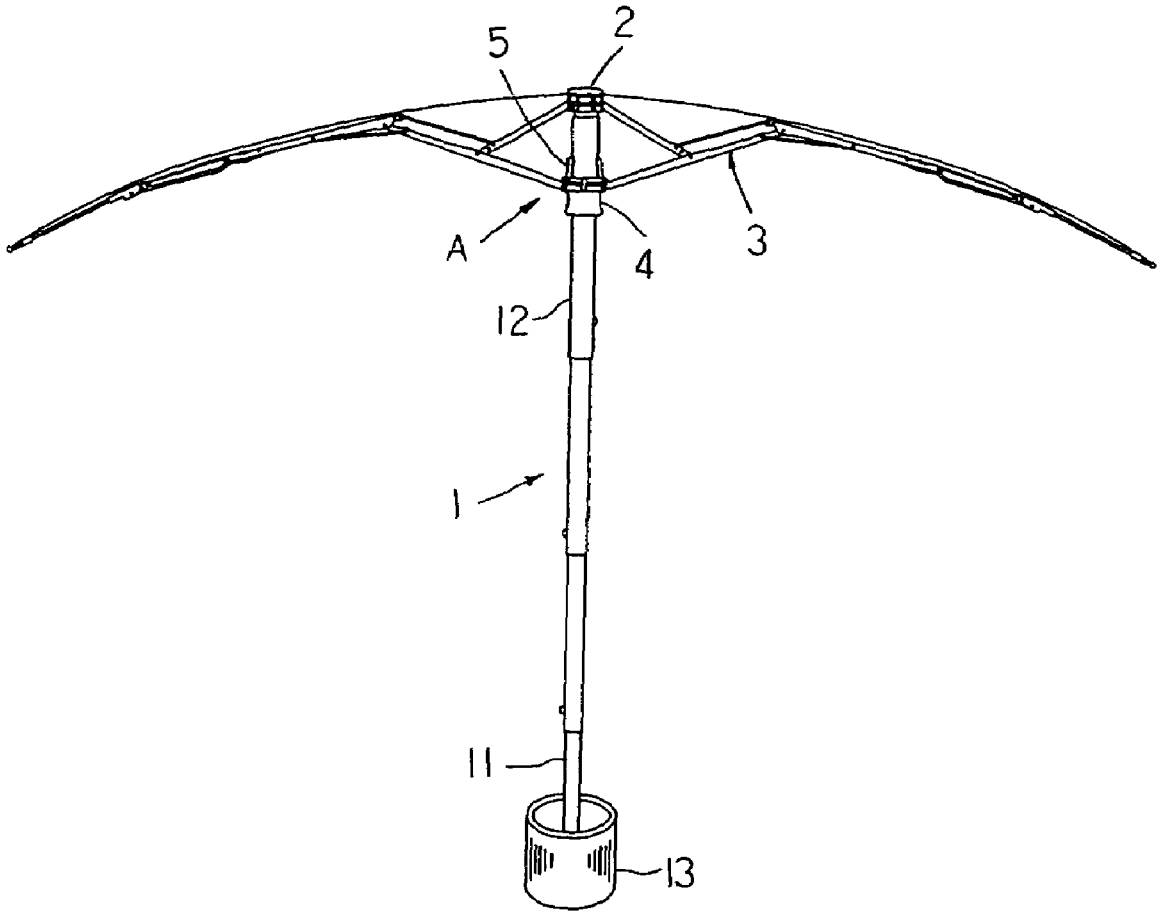
FIG. 1 is a perspective view showing a collapsible umbrella according to an embodiment of the present invention in a fully open configuration.
Figure 2:
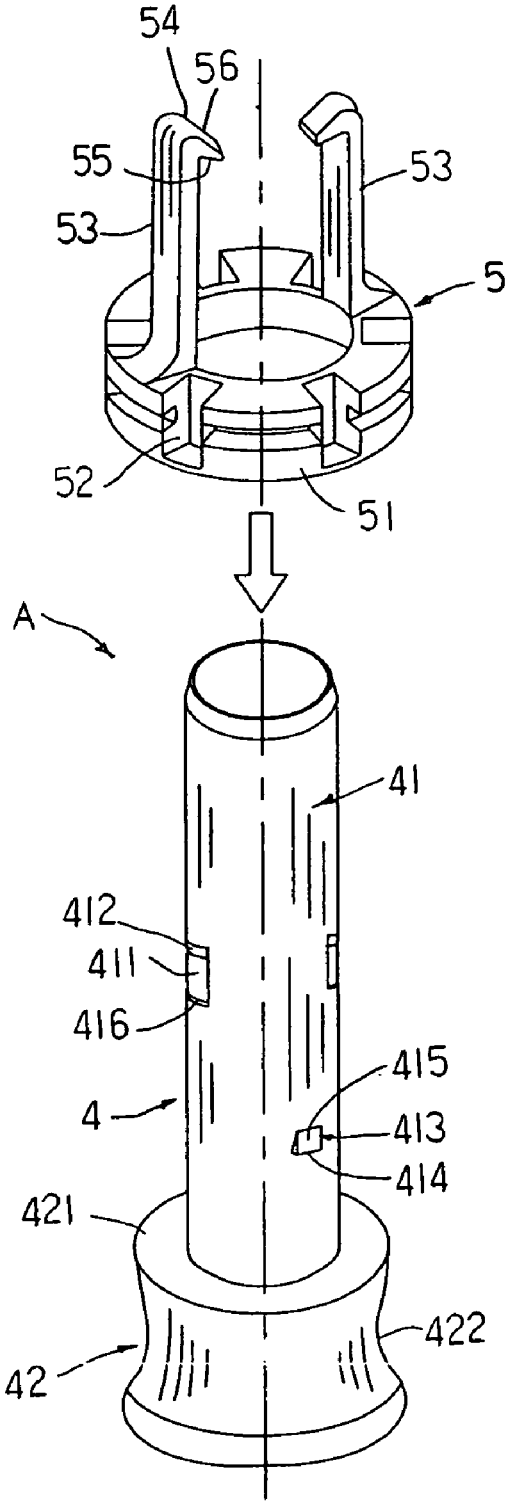
FIG. 2 is a perspective exploded view showing the lower nest structure according to an embodiment of the present invention.
Figure 3:
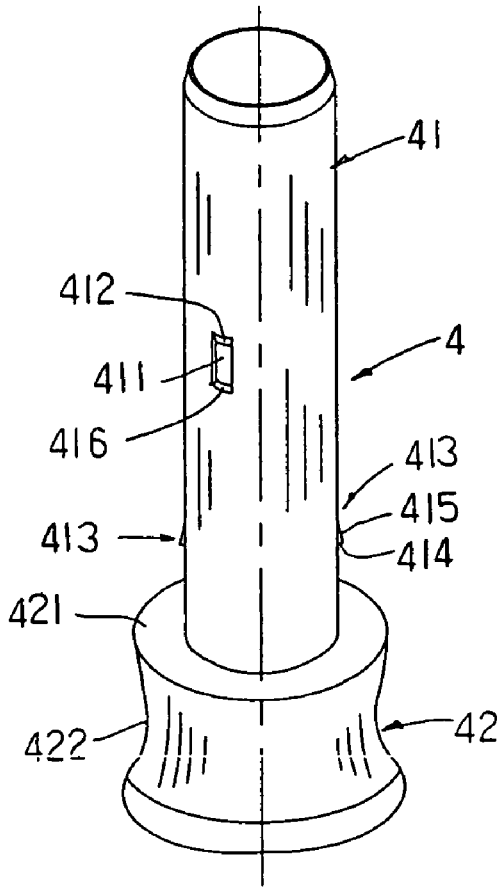
FIG. 3 is a perspective view showing the tubular member of the lower nest structure of FIG. 2 viewed from another angle.

The lower nest structure of the present invention is especially appropriate for a multiple-fold collapsible umbrella as shown in FIG. 1. The central shaft 1 is a telescoping one having four sections with the bottommost section 11 having a smallest diameter and the topmost section 12 having a largest diameter. The upper nest 2 is fixedly attached to the top end of the topmost section 12, while a handle 13 is configured at the bottom end of the bottommost section 11. The ribs of the rib structure 3 have multiple folds and the number of folds is identical to the number of sections of the central shaft 1.

The major characteristic of the present invention is that the lower nest A contains a body member 5 and a tubular member 4, and the topmost section 12 of the central shaft 1 has a pair of positioning holes 14 opposite to each other for locking the lower nest A to maintain the umbrella in an open configuration.

The tubular member 4 is sleeved over the central shaft 1 and could move up and down along the central shaft 1. The tubular member 4 contains a tubular section 41 and an operation knob 42 configured at the bottom of the tubular section 41. A pair of guiding holes 411 are configured on the tubular wall of the tubular section 41, opposing to each other. The guiding holes 411 have a sloped upper edge 412 slanting downward towards the central shaft 1. Another pair of opposing wedges 413 is also configured below the guiding holes 411 on the tubular wall of the tubular section 41. The wedges 413 have a sloped surface 415 slanting upward towards the central shaft 1 from a bottom surface 414. The pair of the wedges 413 and the pair of the guiding holes 411 are configured so that they are interleaved and orthogonal to each other.

The operation knob 42 has a larger diameter than that of the tubular section 41 so that a flange 421 is formed to support a ring section 51 of the body member 5. Around the circumference of the operation knob 42, a curved surface 422 is configured to facilitate a user's operation by his or her fingers 6.

The ring section 51 of the body member 5 is sleeved over the tubular section 41 of the tubular member 4 and is confined by the bottom surfaces 414 of the wedges 413 and the flange 421 of the operation knob 42. The height or thickness of the ring section 51 is substantially smaller than the distance between the bottom surfaces 414 of the wedges 413 and the flange 421 of the operation knob 42, thereby leaving a gap d therebetween. As such, the ring section 51 is able to move up and down between the bottom surfaces 414 and the flange 421. When the tubular member 4 is pulled downward to close the umbrella, within the spacing d, the sloped upper edges 412 of the guiding holes 411 lift and expand the hook elements 53 of the body member 5 to relieve the locking of the hook elements 53 to the positioning holes 14, and then the tubular member 4 drags the body member 5 along with it when moving downward. More details will be given later.

To assemble, the ring section 51 of the body member 5 is sleeved over the tubular section 41 of the tubular member 4 until it passes over the wedges 413, which is facilitated by the sloped surfaces 415 of the wedges 413.

Around the ring section 51 of the body member 5, a number of rib slots 52 are configured for joining with the ribs of the rib structure 3. On top of the ring section 51, a pair of hook elements 53 is configured, opposing to each other. The hook elements 53 are configured such that the reversed hooks 54 at the top ends of the hook elements 53 are roughly corresponding to the guiding holes 411 of the tubular member 4, and the reversed hooks 54 are able to penetrate through the guiding holes 411. The reversed hooks 54 of the hook elements 53 could be flexibly expanded outward and, in the mean time, the hook elements 53 would exert a force on the reversed hooks 54 to clasp inward. The reversed hooks 54 have a sloped surface 56 slanting downward towards the central shaft 1. The tip of the sloped surface 56 is a flat surface 55 which could cling to the bottom edge 416 of the guiding hole 411. When the tubular member 4 is pulled downward to close the umbrella, the sloped upper edges 412 of the guiding holes 411 would lift the sloped surfaces 56 of the reversed hooks 54 so that the reversed hooks 54 are expanded outward.

Figure 5:
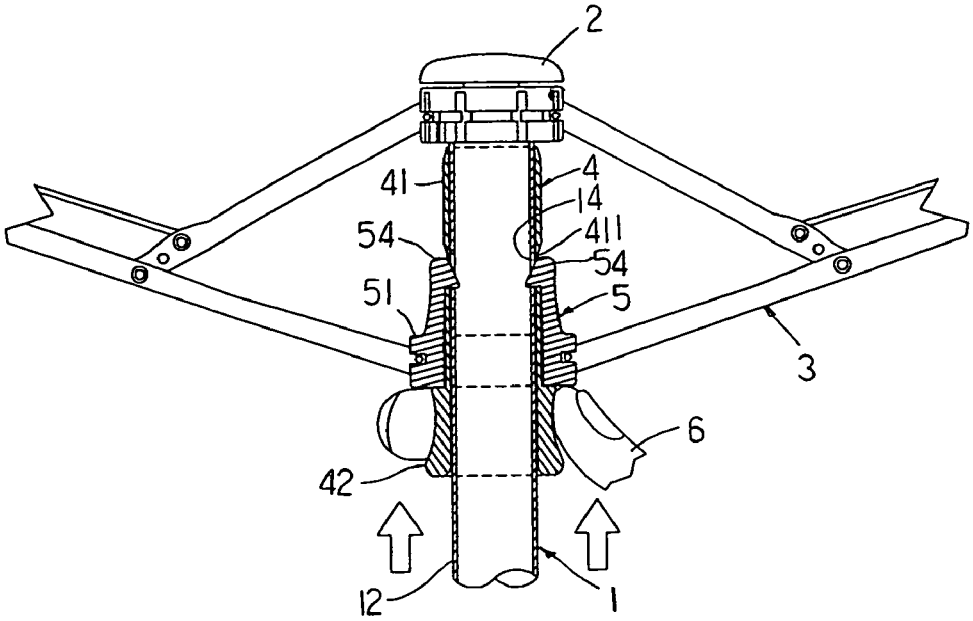
FIG. 5 is a side view showing the lower nest structure of FIG. 2 when it reaches a final position for sustaining the opened umbrella.
Figure 4:
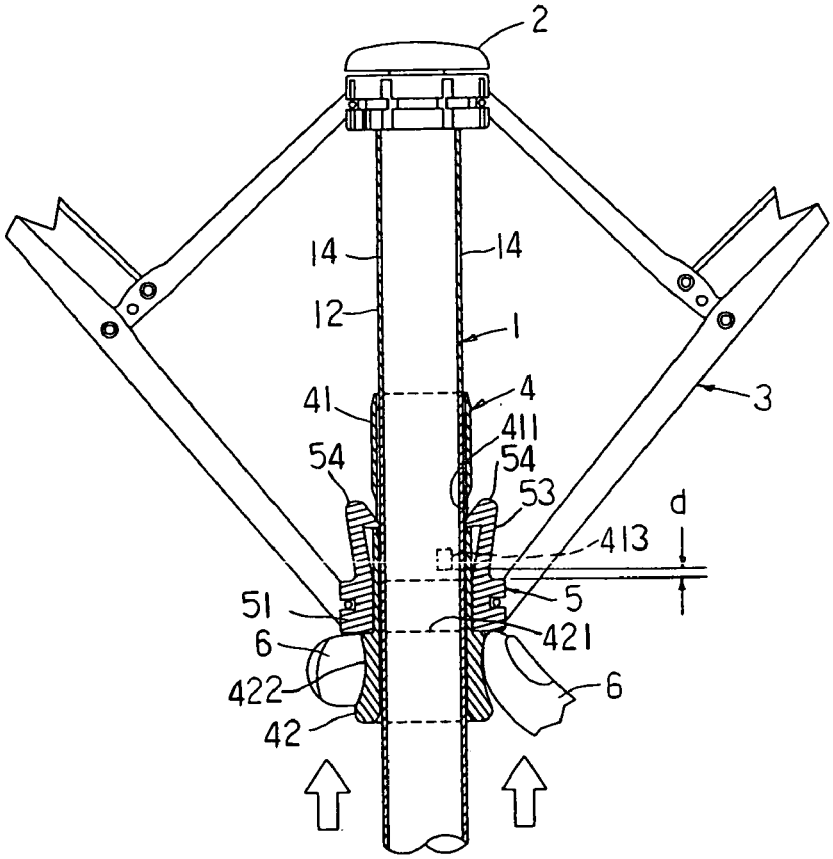
FIG. 4 is a side view showing the lower nest structure of FIG. 2 when it is operated to open the umbrella.

Please refer to FIGS. 4 and 5. When opening the umbrella, a user uses his or her fingers 6 to hold the operation knob 42 and pushes the tubular member 4 upward along the central shaft 1. As the ring section 51 of the body member 5 is resting on the flange 421 of the operation knob 42 and, therefore, the body member 5 is slid upward as well (as shown in FIG. 4). Since the ribs of the rib structure 3 are joined to the ring section 51 of the body member 5, the ribs are also pushed upward to open the umbrella. When the body member 5 reaches an appropriate position, the reversed hooks 54 would penetrate through the guiding holes 411 into the positioning holes 14 of the central shaft 1 (as shown in FIG. 5). The body member 5 is therefore fixed at that position and the umbrella is maintained in an open configuration.

Figure 6:
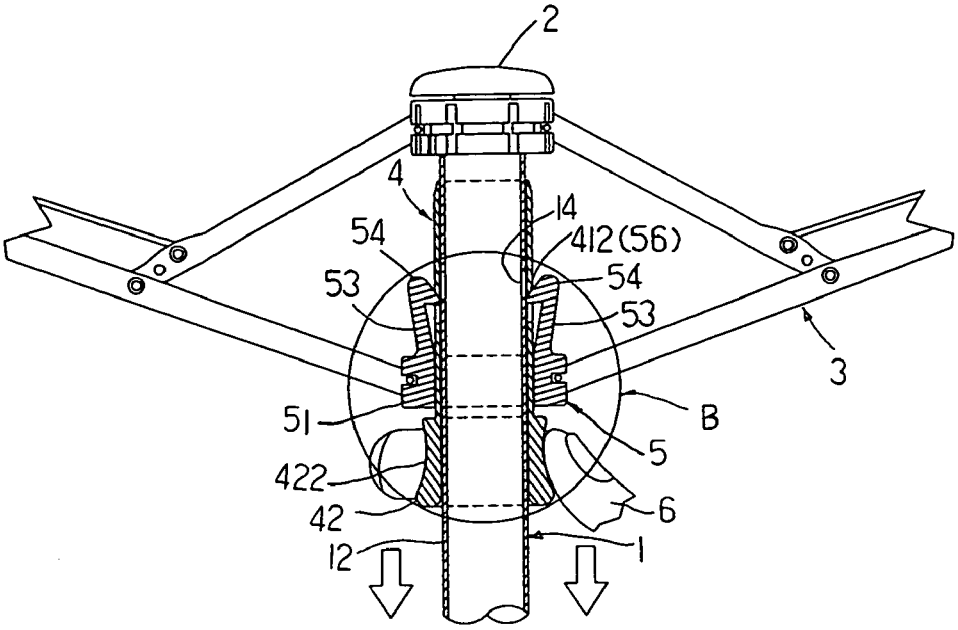
FIG. 6 is a side view showing the lower nest structure of FIG. 2 when it is operated to close the umbrella.
Figure 7:
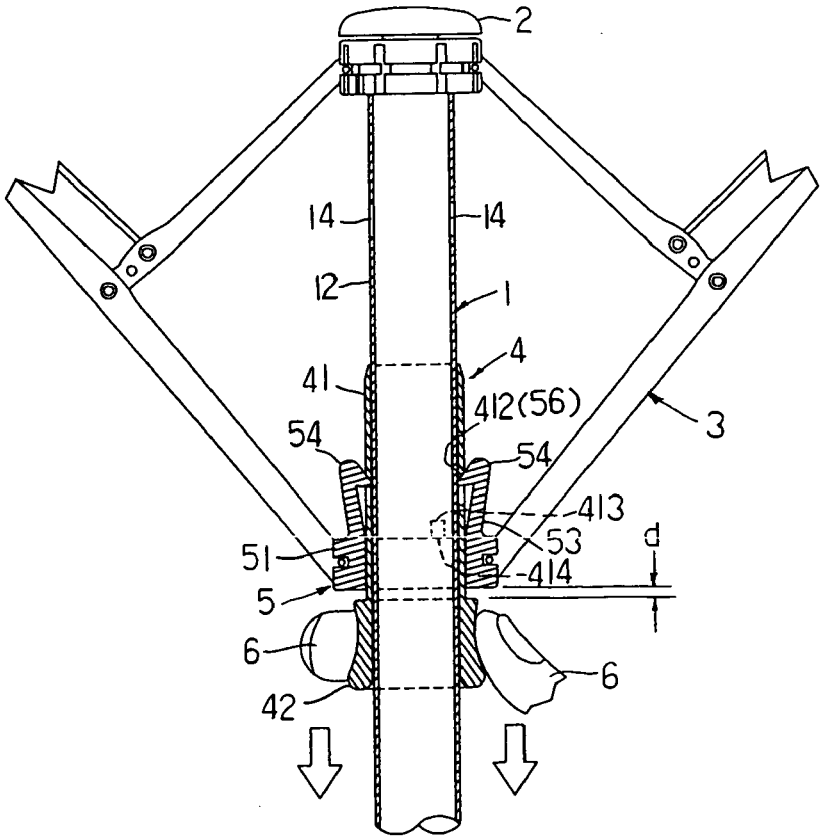
FIG. 7 is a side view showing the lower nest structure of FIG. 2 when it is pulled downward for the closure of the umbrella
Figure 8:
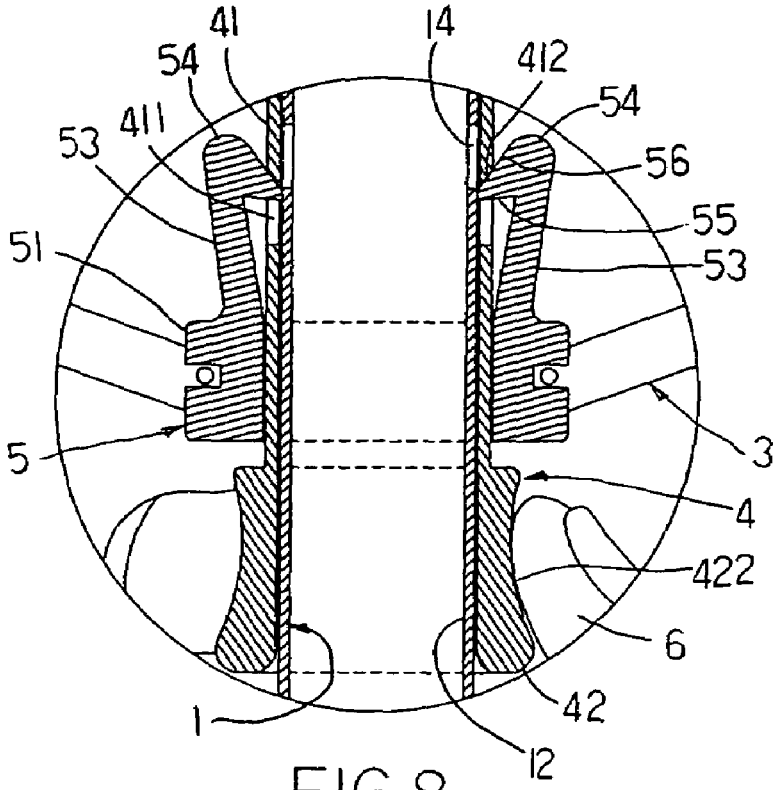
FIG. 8 is an enlarged view showing the section B of the lower nest structure of FIG. 6.
Figure 9:
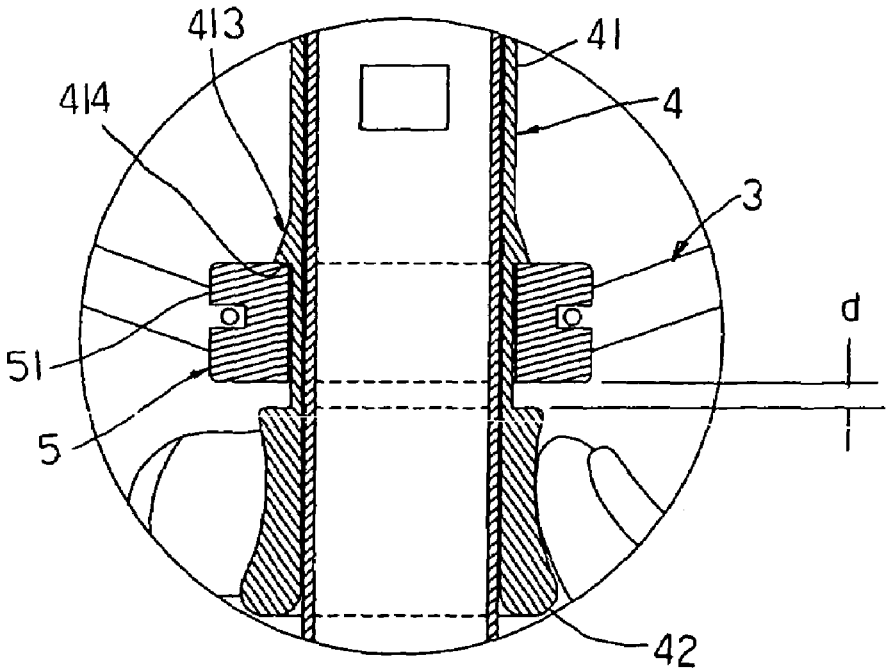
FIG. 9 is an enlarged view showing the lower nest structure of FIG. 7 viewed from another angle.

As shown in FIGS. 6~9, to close the umbrella, a user uses his or her fingers 6 to hold the operation knob 42 and pulls the tubular member 4 downward. First, within the gap d, the sloped upper edges 412 of the guiding holes 411 lift the sloped surfaces 56 of the reversed hooks 54 and, thereby, the reversed hooks 54 are relieved from the positioning holes 14 (as shown in FIGS. 6 and 8). Then, when the tubular member 4 is pulled past the gap d, the bottom surfaces 414 of the wedges 413 would press against the top surface of the ring section 51. The tubular member 4 therefore drags the body member 5 along with it so as to close the umbrella.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A lower nest structure for a collapsible umbrella, said collapsible umbrella comprising a telescoping central shaft made of a plurality of section with the upper sections having larger diameters than the lower sections, an upper section of said central shaft having a pair of positioning holes opposing to each other, said collapsible umbrella further comprising an upper nest configured on the top end of a topmost section of said central shaft, a rib structure whose ribs are connected to both said upper nest and said lower nest, said lower nest comprising:

a tubular member which sleeves over and is able to slide up and down along said central shaft, said tubular member comprising a tubular section and an operation knob configured at the bottom end of said tubular section, a pair of opposing guiding holes being configured around said tubular section, said guiding holes having a sloped upper edge slanting downward towards said central shaft, a pair of opposing wedges being configured below and orthogonal to said guiding holes, said wedges having a protruding bottom surface, said operation knob having a larger diameter than that of said tubular section so as to form a flange; and a body member comprising a ring section which sleeves over said tubular section and is confined by said flange and said bottom surface of said wedges between which said ring section is able to move up and down, the height of said ring section being substantially smaller than the distance between said flange and said bottom surface of said wedges so that a gap is formed therebetween, said ring section having a plurality of rib slots for joining the ribs of said rib structure, said body member further comprising a pair of opposing hook elements configured on top of said ring section which could be expanded outward flexibly and thereby exert an inward force, reversed hooks being configured on the top ends of said hook elements roughly corresponding to the locations of said guiding holes, said reversed hooks having a sloped surface slanting downward towards said central shaft, said reversed hooks being able to penetrate through said guiding holes;

wherein, when said tubular member is pushed upward, said body member is taken along with said tubular member; when said tubular member reaches an appropriate position, said reversed hooks penetrate through said guiding holes and into said positioning holes of said central shaft; said lower nest is therefore fixedly locked to said position to sustain said collapsible umbrella in an open configuration; when said tubular member is pulled downward, said body member is taken along with said tubular member, said sloped upper edges of said guiding holes lift said sloped surfaces of said reversed hooks so as to relieve said reversed hooks from said positioning holes, said lower nest is therefore able to slide downward to close said collapsible umbrella.

2. The lower nest structure according to claim 1, wherein a curved surface is configured around the circumference of said operation knob.

3. The lower nest structure according to claim 1, wherein said wedges have a sloped surface slanting upward towards said central shaft.

* * * * *